United States Patent [19]

Beckerer, Jr.

[11] Patent Number: 4,508,303

[45] Date of Patent: Apr. 2, 1985

[54] HOLDER FOR CONTAINERS

[76] Inventor: Frank S. Beckerer, Jr., 40 Dock Rd., Milford, Conn. 06460

[21] Appl. No.: 138,964

[22] Filed: Apr. 10, 1980

[51] Int. Cl.[3] ..... A47K 1/08

[52] U.S. Cl. ..... 248/311.2; 211/75

[58] Field of Search ..... 248/311.2, 311.3, 309 R, 248/310, 312.1, 313, 314, 315, 316 R; 211/75, 74, 88

[56] References Cited

U.S. PATENT DOCUMENTS

| | | | |
|---|---|---|---|
| 385,174 | 6/1888 | Fahnestock | 211/75 UX |
| 1,319,334 | 10/1919 | Hartung | 248/302 X |
| 2,471,825 | 5/1949 | Long | 248/314 |
| 2,500,905 | 3/1950 | Raykoff | 211/75 X |
| 2,505,387 | 4/1950 | Dantzler | 248/309 R |
| 3,391,891 | 7/1968 | Garden | 211/75 X |
| 3,429,542 | 2/1969 | Fagan | 211/75 X |
| 3,473,772 | 10/1969 | Nilson | 248/311.2 X |
| 3,498,470 | 3/1970 | Thomas | 211/74 |
| 3,533,526 | 10/1970 | Adell | 248/311.2 X |
| 3,696,916 | 10/1972 | Penniman | 248/311.2 X |

FOREIGN PATENT DOCUMENTS

| | | | |
|---|---|---|---|
| 362808 | 12/1931 | United Kingdom | 248/310 |

*Primary Examiner*—J. Franklin Foss

*Attorney, Agent, or Firm*—H. Gibner Lehmann; K. Gibner Lehmann

[57] ABSTRACT

A one-piece container holder constituted of resilient, molded plastic substance, for supporting containers such as bottles, cans, marine air horns, etc., having slightly differing outer dimensions, the holder comprising an open-top body with side walls of generally arcuate cross-section, adapted to encircle the container, and further having a bottom wall for engagement with the container in order to support the same. There is provided on the side walls a flat portion which is adapted to mount against a generally vertical wall of a vehicle or boat, or on a dock or pier. The arrangement is such that the body side walls can expand a limited extent, in order to accommodate containers of varying diameter.

20 Claims, 16 Drawing Figures

HOLDER FOR CONTAINERS

BACKGROUND

This invention relates generally to holder devices for securement to the walls of a vehicle or boat, and more particularly to devices which can be readily manufactured at low cost, and installed with a minimum of effort in an existing structure.

Numerous arangements for holding glass bottles, metal cans, cups, etc. and other containers have been proposed, and have met with varying degrees of success. Prior beverage container holders have incorporated cup-like plastic casings constituted of polyethylene or other relatively rigid plastic material, or metal, and were provided with supporting arms or brackets by which they could be cemented in place on, or otherwise adhered to, a vertical wall of a vehicle or boat. In addition, over the past few years a number of devices have been manufactured which incorporate multiple pivot mountings for a cup-like holder, such that the latter would remain in a substantially vertical or upright position even as the vehicle or boat keeled. Such arrangements seemed to operate in a generally satisfactory manner as far as their intended purpose was concerned, that being to minimize the likelihood of the liquid in an open vessel being inadvertently spilled.

In almost all of the prior devices heretofore known, several disadvantages became apparent. In the holder of the multiple-pivot type, the manufacture involved a number of separate parts which had to be molded independently of one another and thereafter assembled, this resulting in increased manufacturing expense. Some of these devices tended to be fragile, and were prone to breakage or malfunction if they were accidentally jarred, or bumped by occupants of the automobile or boat. In addition, there was a tendency for ropes or lines to snag on the holder, or become fouled or entangled therewith, particularly the under surfaces thereof. In the event that such holders were inadvertently used as a perch or step, they often were torn off the mounting surface, or else became broken or otherwise disfigured.

Also, there was typically made no provision for accommodating containers of slightly different size. Instead, the general approach was to make the opening of the holder sufficiently large to receive the largest of the containers with which the holder was intended to be used; smaller containers could be accommodated, but there resulted a relatively loose or sloppy fit. Such installations were somewhat less than satisfactory for smaller bottles, since they tended to shift position in the holder in response to bumps experienced by the automobile or keeling of the boat.

SUMMARY

The above disadvantages and drawbacks or prior container-holder devices for boats, automobiles, or piers, are largely obviated by the present invention which has for an object the provision of a novel and improved container holder which is extremely simple in construction, inexpensive to manufacture, and both easy to use and reliable in operation.

A related object is the provision of a holder as above which can be readily molded of relatively soft, resilient plastic, so as to reduce the manufacturing cost to an absolute minimum.

Still another object of the invention is the provision of a holder as above characterized wherein it can be readily installed in a boat or automobile, or on a dock, with simple tools, and requiring no special skill on the part of the user.

Yet another object of the invention is the provision of a holder which is especially rugged, thereby being immune to damage from inadvertent bumping, jarring, etc. The holder can be constituted of flexible PVC, or thermoplastic rubber, so as to be essentially uncrushable. It is believed that the device of the present invention is the first of its kind, as far as this capability to resist permanent damage from crushing-type forces is concerned. Also, in the event that someone attempts to use the device as a perch or "step", the soft material of which the holder is constituted will yield, as opposed to breaking or tearing, thus indicating immediately to the person that the device will not support any substantial weight and should not be used as a "step".

A still further object is to provide a holder as above characterized which is so designed to reduce the possibility of ropes or lines becoming entangled thereon, thereby reducing the likelihood of damage to or breakage of the holder.

Another object of the invention is the provision of a holder device which can accommodate containers of somewhat different outer diameter, such that regardless of minor variations in its nominal size, a particular bottle or can-type container can be held in a snug manner, thus minimizing the likelihood of dislodgment of the container, or inadvertent spillage of the contents thereof.

The above objects are accomplished by the provision of a one-piece container holder of resilient molded plastic substance for supporting the container on a wall of a vehicle, boat, or pier, the holder comprising an open-top body having side walls adapted to encircle the container, and having means at the bottom, engageable with the container to support the same, the body walls having a flat portion for engagement with and securement to the wall, and the body being radially expansible to accommodate containers of varying diameters.

Other features and advantages will hereinafter appear.

In the drawings, illustrating several embodiments of the invention:

Figure 1:
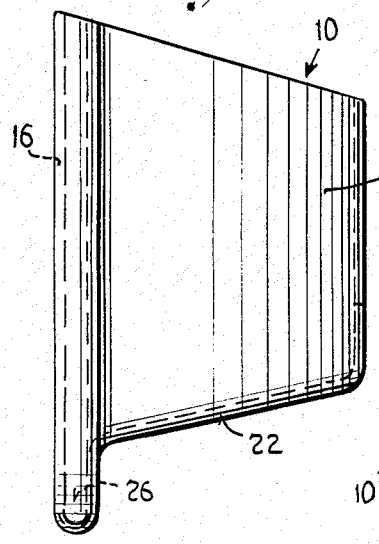
FIG. 1 is a side elevational view of a one-piece, molded container holder constructed in accordance with the present invention, and particularly illustrating a side wall portion of the holder which is adapted to encircle the container.
Figure 2:
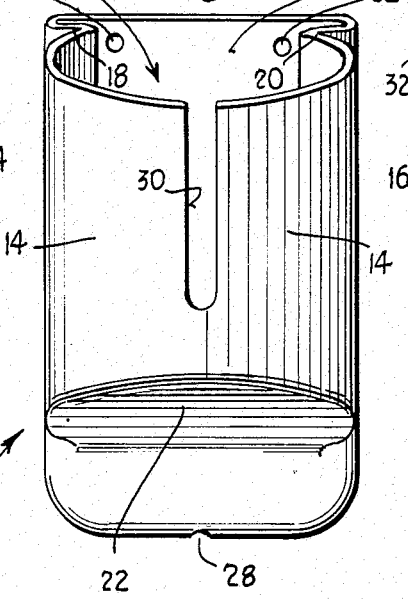
FIG. 2 is a front elevational view of the holder of FIG. 1, and particularly showing a vertical slot in the side wall, adapted to accommodate the handle of a cup-type container.
Figure 4:
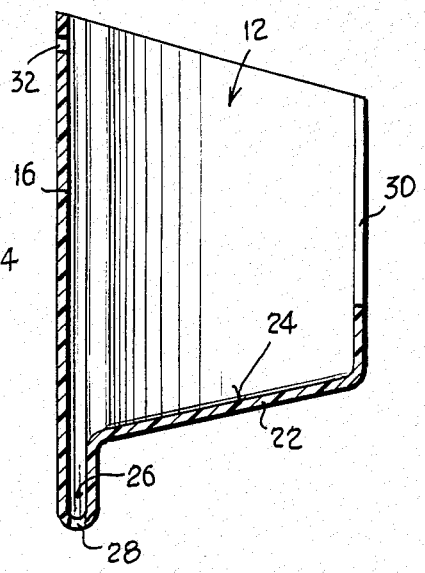
FIG. 4 is a section taken on the line of 4—4 of FIG. 3.
Figure 3:
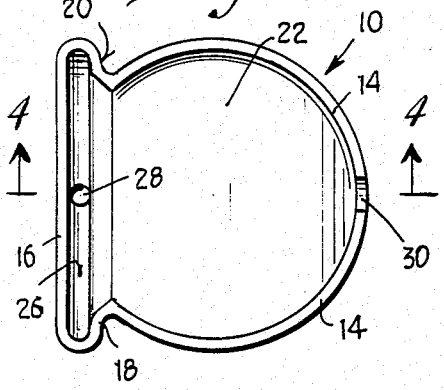
FIG. 3 is a top plan view of the holder of FIGS. 1 and 2.

Referring to FIGS. 1–4, and in accordance with the present invention there is provided a novel and improved one-piece container holder adapted to be mounted on a supporting surface such as a generally vertical wall of a vehicle or a boat, or on a pier, the holder being generally designated by the numeral 10. As illustrated, the holder has an open top 12, and includes side walls 14 and 16, the latter being in the form of a flat mounting portion which is intended to butt against the wall of the vehicle, boat or to be secured on the pier. The side walls 14 are generally of arcuate cross section. Integral with the side walls 14 is a bottom wall 22 which in the illustrated embodiment is substantially flat, and which is skewed with respect to the side walls 14 and 16. The upper surface 24 of the bottom wall 22 constitutes a drain surface which channels any rain water, drips, or spills from the container in a direction toward the mounting portion 16, and into a small sump or reservoir 26. A small drain hole 28 can optionally be provided, if desired. The holder can further include an elongate slot 30, especially adapted for receiving the handle of a cup, mug, etc. where containers provided with such fixtures are intended to be used. Multiple mounting holes 30, 32 enable the holder 10 to be secured in the proper vertical position on the desired wall or post.

By the present invention, the side walls 14 are capable of a limited amount of expansion in radially-outward directions, in order to accommodate beverage or other type containers of somewhat varying external dimensions. In accomplishing this, the walls 14 meet the wall 16 at a pair of expansion joints 18, 20 which are in the form of elongate webs of zig-zag of S-shaped cross sectional configuration. This features of expandability of the side walls 14 is particularly shown in FIGS. 13 and 14. The present holder is especially useful with molded glass bottles of the kind that are currently in use today, for dispensing gingerale, colas, beer, etc. Due to sloppy manufacturing tolerances which are characteristic of such items, there is a significant unit-to-unit variation in these outer diameters, not only between containers produced in different manufacturing runs but also between different units in the same run. As a result, some bottles come through with a slightly larger outer diameter than others.

The present device is also useful for holding aerosol dispenser cans associated with air-horns.

Figure 13:
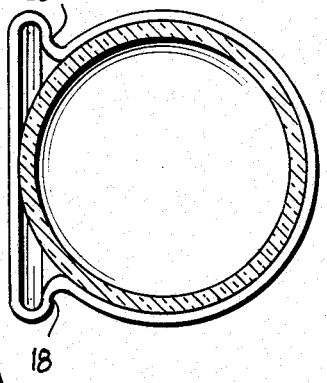
FIG. 13 is a horizontal section of the holder of FIGS. 1–4, shown carrying a container or bottle of conventional configuration.
Figure 14:
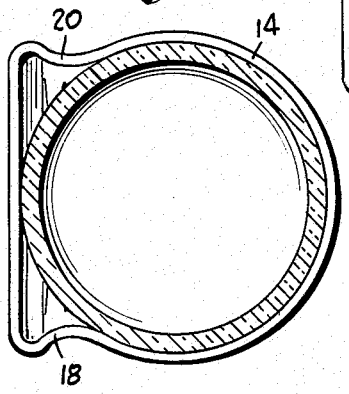
FIG. 14 is a view like FIG. 13, except illustrating the holder carrying a bottle of slightly increased overall dimension, and illustrating a slight expansion of the side walls of the holder, to accommodate the increased size and provide a snug retention.

In prior holder devices where it was desired to have a close fit between the walls of the holder and the walls of the container, there was sometimes encountered interference. One way around this problem, of course, was to make the holder sufficiently large to accommodate the largest container with which the unit was intended to be used. However, this gave rise to a sloppy fit in some circumstances, and was considered by some people to be an unsatisfactory solution. FIG. 13 illustrates the holder 10 being employed with a relatively small size bottle, having an outer diameter substantially the same as the nominal dimensions between the side walls 14. Under such circumstances, little or no expansion of the side walls 14 has occurred, and the joints 18 and 20 have remained relatively undeformed. FIG. 14 shows the holder 10 being employed with a slightly larger bottle, the latter having the effect of forcing the walls 14 radially outward, and giving rise to a deformation of the expansion joints 18, 20. It can thus be seen that, within limits, the holder 10 can accommodate different-sized bottles or containers without sacrificing a snug fit, since the resilience of the expansion joints 18, 20 enables a limited outward yielding of the side walls 14 to occur when an oversized container is being accommodated, as well as operating to provide a limited retraction of the side walls 14 when such an oversized container is removed.

Another embodiment of the invention is shown in FIGS. 5–8, illustrating a somewhat modified container holder generally designated by the numeral 10*a*, the holder comprising side walls 14*a* and 16*a*, the latter shown as being flat and adapted to butt against the vertical wall of a vehicle or boat. As in the previous embodiment, the holder has a reservoir 26*a*, constituted as a flat compartment with substantially parallel, coextensive front and rear walls 27, 29. Near the top of the wall 16*a* are multiple mounting holes 30*a*, 32*a*. An additional hole 33 in the wall 29 enables the holder to be secured in place by means of suitable screws. A fourth hole 35 is provided in the wall 27, serving both as a clearance hole for a screwdriver, during installation of the screw carried by the hole 33, and also as a drain passage. The above construction involving the large hole 35 which provides clearance for the screw head, eliminates the possibility of the screw squeezing the walls 27, 29 together, and posibly cutting off the drainage function of the sump 26*a*. This consideration would be of consequence if a drain passage similar to that indicated by the numeral 28 were to be incorporated in the holder 10*a*.

Figure 7:
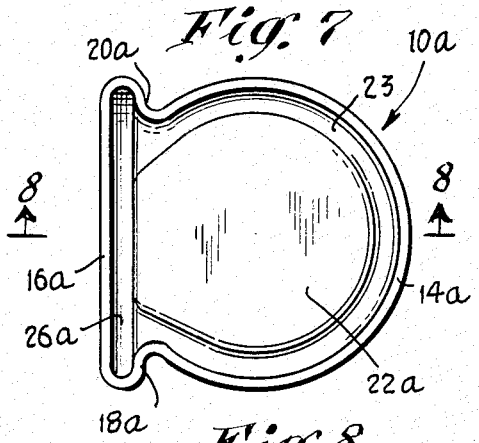
FIG. 7 is a top plan view of the holder of FIGS. 5 and 6.
Figure 5:
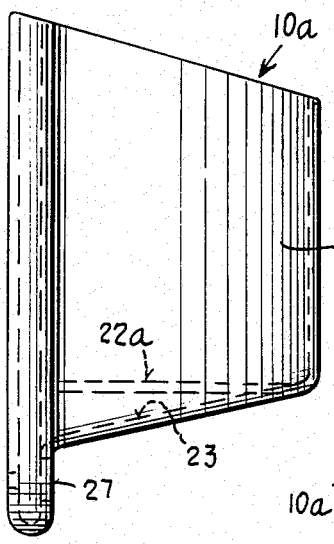
FIG. 5 is a side elevational view of a somewhat modified holder, incorporating a transverse bottom wall which has a central portion that is substantially perpendicular to the side walls, and further having a peripheral drain trough for catching drips.
Figure 6:
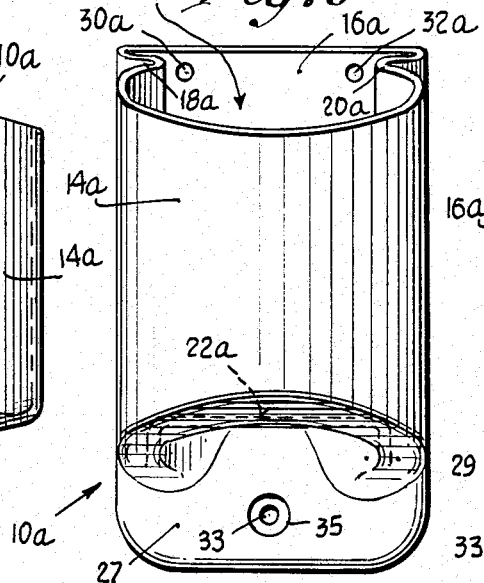
FIG. 6 is a front elevational view of the holder of FIG. 5.
Figure 8:
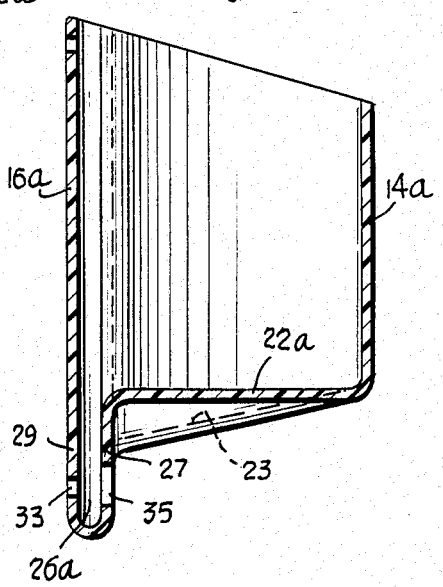
FIG. 8 is a vertical section taken on the line 8—8 of FIG. 7.
Figure 9:
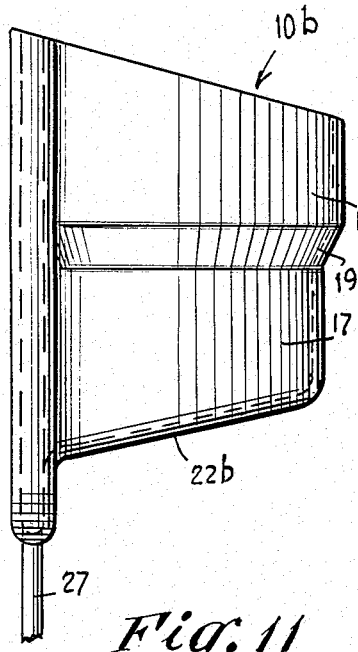
FIG. 9 is a side elevational view of a further modified holder device, incorporating a stepped side wall, for accommodating containers of substantially different diameters, and incorporating a drain tube for channeling drips and spillage from the interior of the container to a remote location.

The holder 10*a* further comprises a support means for the container, in the form of a bottom wall comprising a plateau portion 22*a*, which is substantially circular as can be seen in FIG. 7, and a peripheral trough 23 integral with the portion 22*a*, and constituting a drain surface for catching rain water, drips or spillage from the container and for channeling the liquid to the reservoir 26*a*. The plateau portion 22*a*, being generally perpendicular to the side walls 14*a* and 16*a*, provides an improved seat for bottle-like and can-like containers, as can be readily understood.

Further in accordance with the invention, the holder 10*a* comprises two expansion joints 18*a*, 20*a*, respectively, being in the form of elongate webs of generally S-shaped cross section. The joints 18*a*, 20*a* are capable of limited expansion, enabling the size of the opening 12*a* to be increased somewhat in the event that a large diameter container is employed with the holder. Although the embodiment of FIGS. 5–8 does not show a slot similar to that indicated by the numeral 30 in FIG. 2, it can be readily understood that such a slot could be incorporated in this holder construction, if so desired. The provision of such a slot would, of course, give added capability for expansion, since the side walls 14 on opposite sides of the slot could move in directions generally opposite to one another if a larger-sized container were being received.

Still another embodiment of the invention is illustrated in FIGS. 9–12, wherein there is shown a further modified holder 10*b*, having an open top 12*b*, and side walls 14*b* and 16*b*. The wall 16*b* is substantially flat, for engagement with the wall of the vehicle with which the holder is to be used. Mounting holes 30*b* and 32*b* are also provided.

In accordance with the present invention, the side wall 14*b* is constituted of two sections, one being designated by the numeral 15, and the other being indicated 17. The section 15 is of relatively large dimension with respect to the section 17, the two sections being joined by a somewhat conical ledge or tapered section, or funnel 19.

Figure 10:
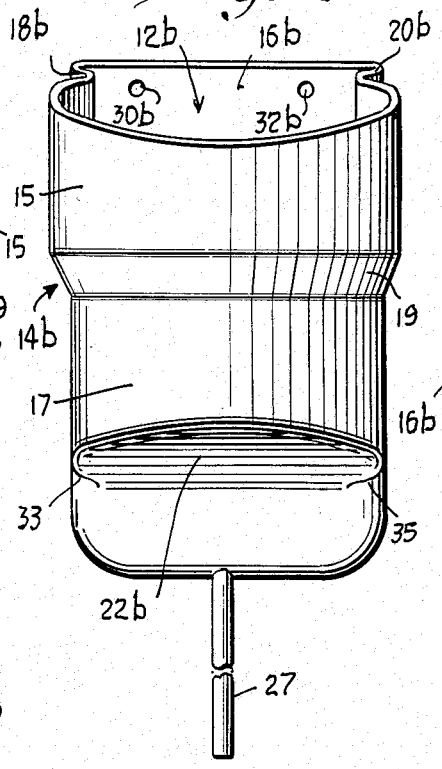
FIG. 10 is a front elevational view of the holder of FIG. 9.
Figure 12:
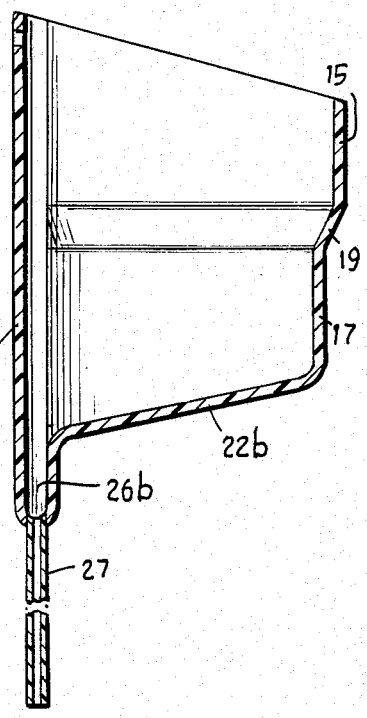
FIG. 12 is a vertical section taken on the line 12—12 of FIG. 11.
Figure 11:
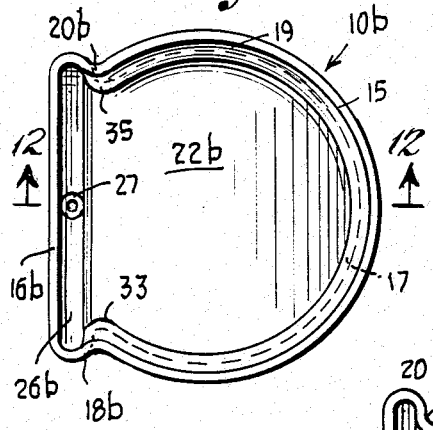
FIG. 11 is a top plan view of the holder of FIGS. 9 and 10.

A reservoir 26*b* is provided, drainage from which is accomplished by means of a tube 27 which can be of any suitable length, so as to channel liquid to a remote area, either the bilge of the boat, or a drain area of a door in the event that the holder is intended to be used with an automotive vehicle. The provision of the two sections 15, 17 permits the holder 10*b* to be used with a number of different size containers. The large diameter section 15 will accommodate containers of increased diameter, with the lower rim of the container resting against the ledge or section 19. With smaller containers, the body can be accommodated in the section 17, with the section 19 constituting a guide during insertion of the container. When a smaller container is held in section 17, the section 15 will act as a collector to receive spills from the container, and to channel them to the reservoir 26*b*. In the present construction, the section 15 is provided with expansion joints 18*b*, 20*b*, with the smaller section 17 having similar joints 33, 35. This arrangement enables an independent expansion of the two sections, as required by the size of the particular container with which the holder is being used. These joints 18*b*, 20*b*, 33 and 35 are best shown in FIGS. 10 and 11, being in the form of elongate webs of generally zig-zag or S-shaped configuration.

Figure 15:
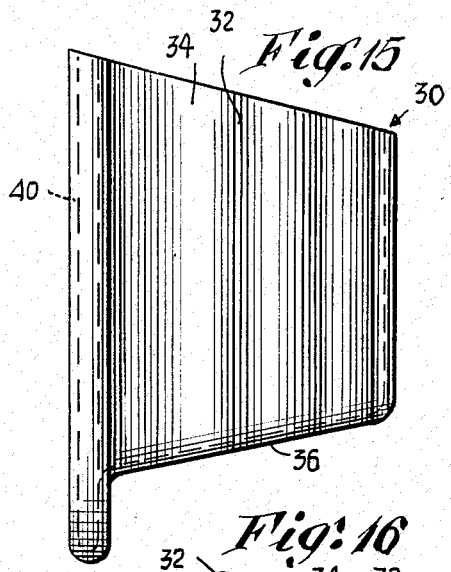
FIG. 15 is a side elevational view of a still further modified holder construction, incorporating a somewhat corrugated or fluted side wall that is capable of increased expansion, as might be required in order to accommodate containers of widely varying dimensions.
Figure 16:
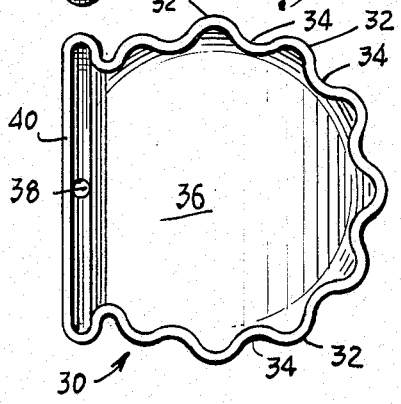
FIG. 16 is a top plan view of the holder of FIG. 15.

Another embodiment of the invention is illustrated in FIGS. 15 and 16. In this embodiment the side walls of the container, designated by the numeral 30, are of fluted or scalloped configuration, having a plurality of vertical ribs 32 intermixed with the vertical or bottom grooves 34. The ribbed and grooved portions of the side walls 32, 34 meet and are joined to the bottom wall 36 which latter slopes downward to the rear of the holder so as to carry off liquid through a drain opening 38. The holder of FIGS. 15 and 16 has a flat portion 40 adapted to engage and be secured to a vertical supporting wall, as with the other forms of the invention.

The fluted or scalloped configuration of the side walls 30 enables them to readily accommodate containers of larger diameter, since the ribs 32 and grooves 34 will tend to flatten for this purpose. Thus, the fluted configuration performs the function that is otherwise formed by the portions 18, 20 or 18*a*, 20*a* in the previously described embodiments of the invention.

With the above construction wherein the top portion (rim or lip) is sloped with respect to the horizontal, as in FIG. 1, there is discouraged the use of the holder as a "step" or perch. In addition, the sloping bottom 22 minimizes the likelihood of the holder snagging ropes or lines that are moving upwardly, thus eliminating the possibility of tearing or breakage of the holder. Also, the holder's outer surface can be made very smooth, depending on the quality of the mold, so as to present a somewhat slippery exterior which permits ropes or lines to slide past the holder rather than snagging the same.

From the above it can be seen that I have provided novel and improved holders for containers of various kinds, the units being especially simple in construction and economical to manufacture. The molded plastic constructions have been found to be exceptionally rugged in use, and virtually completely immune to damage or breakage from inadvertent bumping or rough handling. The devices are thus well-suited to the harsh environment which characterizes marine facilities and transportation vehicles. The holders are thus seen to represent distinct advances and improvements in this technological field.

Variations and modifications are possible without departing from the spirit of the invention.

What is claimed is:

1. A one-piece holder of resilient molded plastic substance for supporting a container on a supporting surface of a vehicle, boat, or pier, comprising in combination:

(a) an open-top vertical body having side walls adapted to encircle the container, and having means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) said container support means comprising an expansive bottom wall disposed transverse to said side walls, and (e) means providing a sump for collecting liquid resulting from rain water, splashes, or spillage onto the surface of said bottom wall, (f) said sump being disposed adjacent to the mounting portion of said body wall.

2. The invention as defined in claim 1, wherein:

(a) said bottom wall slopes downward toward the sump when the holder is disposed in a generally upright position, said bottom wall constituting a drain surface.

3. The invention as defined in claim 1, and further including:

(a) means defining an aperture communicating with the sump, so as to provide for drainage of liquid therefrom.

4. The invention as defined in claim 3, and further including:

(a) a tube connected with the aperture, for providing drainage of liquid from the sump to a remote location.

5. The invention as defined in claim 3, wherein:

(a) the aperture is disposed at the lowest joint in the sump when the holder is in an upright position.

6. The invention as defind in claim 1, wherein:

(a) said sump is constituted as an elongate, substantially flat compartment having generally flat, coextensive front and rear walls, disposed in generally vertical planes when the holder is in an upright position.

7. The invention as defined in claim 6, wherein:

(a) one sump wall has an aperture to receive a mounting screw, (b) the opposite sump wall has an aperture substantially aligned with the first and constituting a drain aperture, (c) said drain aperture also constituting a clearance hole to receive a screwdriver, for enabling quick installation of the said mounting screw.

8. A one-piece holder of resilient molded plastic substance for supporting a container on a supporting surface of a vehicle, boat, or pier, comprising in combination:

(a) an open-top vertical body having side walls adapted to encircle the container, and having means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) said radially expansible means comprising a pair of expansion joints to enable the side walls to be urged in radially outward directions in response to insertion of a container of slightly larger outer diameter than the dimensions between said walls, (e) said expansion joints comprising a pair of elongate webs of substantially S-shaped cross section, disposed at opposite sides of said mounting portion and joining it to remaining portions of the side walls.

9. The invention as defined in claim 8, wherein:

(a) said expansion joints are integral with said mounting portion and remaining portions of the side walls.

10. A one-piece holder of resilient molded plastic substance for supporting a container on a supporting surface of a vehicle, boat, or pier, comprising in combination:

(a) an open-top vertical body having side walls adapted to encircle the container, and having means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) said container support means comprising an expansive bottom wall disposed transverse to said side walls, (e) said bottom wall comprising a central plateau portion for supporting the container, and a peripheral trough portion, (f) said trough portion sloping downward toward the mounting portion of the side walls when the holder is in an upright position, so as to channel liquid resulting from rain water, splashes or spillage toward the said mounting portion.

11. The invention as defined in claim 10, wherein:

(a) said central plateau portion is generally perpendicular to the side walls of the holder.

12. A one-piece holder of resilient molded plastic substance for supporting a container on a supporting surface of a vehicle, boat, or pier, comprising in combination:

(a) an open-top vertical body having side walls adapted to encircle the container, and having means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) the side walls of the body having a fluted configuration of vertical disposition enabling them to expand when a container of larger diameter is inserted.

13. The invention as defined in claim 12, wherein:

(a) the side walls of the body have rounded vertical ribs, and rounded bottom grooves constituting the said fluted configuration of vertical disposition.

14. A one-piece holder of resilient molded plastic substance for supporting a container on a supporting surface of a vehicle, boat, or pier, comprising in combination:

(a) an open-top body having side walls adapted to encircle the container, and having means at the bottom, engageable with the container to support the same, (b) said side walls including a mounting portion for engagement with and securement to said supporting surface, (c) said side walls having means enabling them to be radially expansible so as to accommodate containers of varying girths, (d) said container support means comprising an expansive bottom wall disposed transverse to said side walls, (e) means providing a sump for collecting liquid resulting from rain water, splashes, or spillage onto the surface of said bottom wall, (f) said sump being disposed adjacent to the mounting portion of said body wall, (g) means defining an aperture communicating with the sump, so as to provide for drainage of liquid therefrom, (h) said sump being constituted as an elongate, substantially flat compartment having generally flat, coextensive front and rear walls disposed in generally vertical planes when the holder is in an upright position, (i) said radially expansible means being sufficiently yieldable whereby it enables the side walls to be urged in radially outward directions in response to insertion of a container of slightly larger outer diameter than the dimensions between said walls, (j) said expansible menas comprising a pair of elongate webs of substantially S-shaped cross section, disposed at opposite sides of said mounting portion and joining it to remaining portions of the side walls, (k) said expansible means being integral with said mounting portion and remaining portions of the side wall, (l) said side walls comprising a lower portion of predetermined dimension, and an upper portion of increased dimension, such that containers of two distinct sizes can be accommodated, and (m) said expansible means providing two pairs of expansion joints, one pair connecting the flat portion of the side walls to the said lower portion of predetermined dimension, (n) the other pair of expansion joints connecting the flat portion of the side walls to the said upper portion of increased dimension, (o) said upper and lower portions being capable of limited independent expansion in radially outward directions in response to insertion of relatively small or large containers in the lower or upper portions respectively of the holder side walls.

15. A one-piece holder of resilient molded plastic substance for supporting a container on a supporting surface of a vehicle, boat, or pier, comprising in combination:

(a) an open-top body having side walls adapted to encircle the container, and having means at the bottom, engageable with the container to support the same, (b) said side walls including a generally planar mounting portion for engagement with and securement to said supporting surface, (c) said side walls having means enabling them to be radially expansible so as to accommodate containers of varying girths, (d) said enabling means comprising a pair of elongate expansion joints of generally S-shaped cross section, said expansion joints joining the planar mounting portion of the side walls to the remaining portions thereof, and being integral with the said mounting portion and remaining portions of the side walls, (e) said S-shaped expansion joints being expandible to accommodate said containers.

16. A one-piece holder of resilient molded plastic substance for supporting a container on a supporting surface of a vehicle, boat, or pier, comprising in combination:

(a) an open-top body having side walls adapted to encircle the container, and having means at the bottom, engageable with the container to support the same, (b) said side walls including a mounting portion for engagement with and securement to said supporting surface, (c) said side walls having means enabling them to be radially expansible so as to accommodate containers of varying girths, (d) the open-top being characterized by a lip which is downwardly sloping from the location of the mounting portion toward the portions of the side walls that are opposite the mounting portion, so as to minimize the likelihood of ropes or lines associated with marine equipment from becoming snagged on the said lip, and possibly damaging the holder.

17. A one-piece holder of resilient molded plastic substance for supporting a container on a supporting surface of a vehicle, boat, or pier, comprising in combination:

(a) an open top body having side walls adapted to encircle the container, and having means at the bottom, engageable with the container to support the same, (b) said side walls including a mounting portion for engagement with and securement to said supporting surface, (c) said side walls having means enabling them to be radially expansible to as to accommodate containers of varying girths, (d) said holder having a sloping wall at its bottom, sloping upwardly from the location of the mounting portion toward the portions of the side walls that are opposite the mounting portion, so as to minimize the likelihood of ropes or lines associated with marine equipment from becoming snagged on said sloping bottom wall, and possibly damaging the holder.

18. A one-piece holder of resilient molded plastic substance for supporting a container on a supporting surface of a vehicle, boat, or pier, comprising in combination:

(a) an open-top vertical body having side walls adapted to encircle the container, and having means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) said side walls comprising a lower portion of predetermined dimension, and an upper portion of increased dimension, such that containers of two distinct sizes can be accommodated, (e) means on said side walls providing two pairs of expansion joints, one pair connecting the flat portion of the side walls to the said lower portion of predetermined dimension, (f) the other pair of expansion joints connecting the flat portion of the side walls to the said upper portion of increased dimension, (g) said upper and lower portions being capable of limited independent expansion in radially outward directions, in response to insertion of relatively small or large containers in the lower or upper portions respectively, of the holder side walls.

19. A one-piece holder of resilient molded plastic substance for supporting a container on a supporting surface of a vehicle, boat, or pier, comprising in combination:

(a) an open-top vertical body having side walls adapted to encircle the container, and haing means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) the top portion of the body being sloped with respect to the horizontal, to discharge its use as a step.

20. A one-piece holder of resilient molded plastic substance for supporting a container on a supporting surface of a vehicle, boat, or pier, comprising in combination:

(a) an open-top vertical body having side walls adapted to encircle the container, and having means at the bottom, engageable with the container to support the same, (b) said side walls including a mounting portion for engagement with and securement to said supporting surface, (c) said side walls at one level constituting a continuous and unbroken cross section and at all levels having means enabling them to be radially expansible so as to accommodate containers of varying girths, (d) the bottom portion of the body being sloped with respect to the horizontal, to minimize the likelihood of the body interfering with upwardly moving objects.

* * * * *